US009540936B2

(12) United States Patent
Cantemir et al.

(10) Patent No.: US 9,540,936 B2
(45) Date of Patent: Jan. 10, 2017

(54) LIQUID RING HEAT ENGINE

(75) Inventors: Codrin-Gruie Cantemir, Columbus, OH (US); Fabio Chiara, Columbus, OH (US); Marcello Canova, Columbus, OH (US)

(73) Assignee: Ohio State Innovation Foundation, Columbus, OH (US)

( * ) Notice: Subject to any disclaimer, the term of this patent is extended or adjusted under 35 U.S.C. 154(b) by 760 days.

(21) Appl. No.: 13/989,307

(22) PCT Filed: Nov. 23, 2011

(86) PCT No.: PCT/US2011/062089

§ 371 (c)(1),
(2), (4) Date: Aug. 9, 2013

(87) PCT Pub. No.: WO2012/071538

PCT Pub. Date: May 31, 2012

(65) Prior Publication Data

US 2014/0147244 A1 May 29, 2014

Related U.S. Application Data

(60) Provisional application No. 61/416,401, filed on Nov. 23, 2010.

(51) Int. Cl.
*F01D 9/02* (2006.01)
*F01C 7/00* (2006.01)
(Continued)

(52) U.S. Cl.
CPC . *F01D 9/02* (2013.01); *F01C 7/00* (2013.01); *F01C 21/06* (2013.01); *F04C 19/008* (2013.01)

(58) Field of Classification Search
CPC ..... F01C 7/00
See application file for complete search history.

(56) References Cited

U.S. PATENT DOCUMENTS 1,094,919 A 4/1914 Nash
1,797,980 A * 3/1931 Jennings ..... F04C 19/004 417/68

(Continued)

FOREIGN PATENT DOCUMENTS

DE 19504345 A1 * 8/1996 ..... F01C 7/00

OTHER PUBLICATIONS

International Search Report issued in corresponding PCT application No. PCT/US2011/062089, dated Jun. 26, 2012, 3 pgs.

(Continued)

*Primary Examiner* — Thomas Denion
*Assistant Examiner* — Mickey France
(74) *Attorney, Agent, or Firm* — Meunier Carlin & Curfman LLC

(57) ABSTRACT

A method and at least two devices demonstrate improvements to energy extraction from a compressible working fluid in a liquid ring heat engine, which has a rotor mounted in a case. A space in the case is occupied by a liquid that establishes a liquid ring piston for the rotor. The rotor defines at least a first and a second operating zone. In the first zone, the working fluid is expanded against the liquid and, in the second zone, the working fluid is re-compressed. Between the two zones, the working fluid is cooled. In one device, the cooling step occurs on the rotor in a third zone. In another device, the cooling occurs outside of the case.

13 Claims, 3 Drawing Sheets

(51) Int. Cl.
*F01C 21/06* (2006.01)
*F04C 19/00* (2006.01)

(56) References Cited

U.S. PATENT DOCUMENTS

| | | | | | |
|---|---|---|---|---|---|
| 3,905,198 | A * | 9/1975 | Malaval | F01C 7/00 | 60/669 |
| 4,613,283 | A | 9/1986 | Haavik | | |
| 5,122,035 | A | 6/1992 | Juhola | | |
| 5,222,869 | A | 6/1993 | Wunner et al. | | |
| 5,251,593 | A | 10/1993 | Pedersen | | |
| 5,636,523 | A * | 6/1997 | Assaf | F04C 11/003 | 417/68 |
| 2009/0290993 | A1* | 11/2009 | Assaf | F01C 17/02 | 417/68 |
| 2012/0324886 | A1 | 12/2012 | Assaf | | |

OTHER PUBLICATIONS

Written Opinion of the International Searching Authority issued in corresponding PCT application No. PCT/US2011/062089, dated Jun. 26, 2012, 5 pgs.

* cited by examiner

LIQUID RING HEAT ENGINE

TECHNICAL FIELD

The embodiments disclosed herein relate to an improved liquid ring device for converting thermal energy in the nature of a working fluid into practical mechanical work. More particularly, the improved liquid ring device as described herein incorporates more than one thermodynamic action with the working fluid, including a cooling zone in which the working fluid is cooled.

BACKGROUND

The liquid ring device is known in the prior art, with the concept existing in the patent art at least as early as U.S. Pat. No. 1,094,919 to Nash in 1914. In the Nash '919 device, a combustible gas is introduced into the device, compressed and ignited, with the expansion being used to provide mechanical energy.

In some situations in the prior art, the liquid ring device is used to compress gases at the expenditure of mechanical energy, while, in another type of operation, it is used as an expander to extract thermal energy from a working fluid as practical mechanical work. One application is the recuperation of the energy carried out by the exhaust gases from an internal combustion engine or a gas turbine.

Many other applications are envisioned, in which different working fluids are used. These include, but are certainly not limited to, recuperation processes involving furnace gases, foundry gases, residual industrial steam or geothermal gases, such as from a volcano. In yet other applications, the liquid ring device can be used as a prime mover or stand alone heat engine in conjunction with a hot gas generator of a suitable type. In general, the device is able to operate effectively, once the mode of operation and the energy source has been selected.

It is, however, not known in the prior art to perform more than one thermodynamic transformation in a single liquid ring device.

SUMMARY

This and other unmet advantages are provided by the device and method described and shown in more detail below and as claimed in the appended claims.

This and other advantages are achieved by a liquid ring heat engine (LRHE) that extracts energy from a working fluid. The LRHE has a cylindrical case; a rotor, arranged for rotation on a shaft that is eccentrically mounted inside the cylindrical case; a space, internal to the cylindrical case, for receiving an amount of liquid that effects a piston ring around the rotor as the rotor rotates on the shaft relative to the cylindrical case, as well as an inlet and an outlet for the working fluid. The rotor defines, on a face thereof, a first zone where the working fluid is expanded and a second zone where the working fluid is compressed. To achieve this, a plurality of vanes are arranged in spaced-apart relationship, on at least one of the rotor faces.

In one embodiment, the plurality of vanes are arranged symmetrically on only one face of the rotor, and, in this embodiment, each of the first and second zones is located on the face of the rotor on which the vanes are arranged.

In this embodiment, the rotor further defines a third zone, positioned in a rotational sense between the first and second zones; with a means for cooling the working fluid operatively arranged in the third zone.

In another embodiment, the plurality of vanes are arranged symmetrically on each of the two faces of the rotor, with the first and second zones located on the respective first and second faces of the rotor.

In this second embodiment, the LRHE further comprises an intermediate outlet for the working fluid, a means for cooling, located external to the cylindrical case, and an intermediate inlet for the working fluid. The intermediate outlet, the cooling means and the intermediate inlet define a conduit such that the working fluid exits the first zone, passes through the cooler and enters the second zone.

In the first embodiment, the inlet and outlet are each arranged radially with respect to the shaft.

In the second embodiment, the inlet and the intermediate outlet are arranged radially with respect to the shaft, but the intermediate inlet and the outlet are arranged axially with respect to the shaft.

In the second embodiment, the LRHE also comprises a flange, inside the cylindrical case, that coacts with the rotor to effectively divide the internal space of the cylindrical case into an expander portion and a compressor portion.

In at least the first embodiment, the LRHE further comprises a sealing surface, in fixed angular position relative to the rotor, operating with the vanes and rotor face to trap the working fluid inside the rotor during the expansion thereof in the first zone. The LRHE can also comprise a sealing surface, in fixed angular position relative to the rotor, that operates with the vanes and rotor face to trap the working fluid inside the rotor during the compression thereof in the first zone.

The advantages are also achieved by a method of extracting energy from a compressible working fluid. In the method, the working fluid is injected into a LRHE comprising a rotor that defines at least a first and a second zone. The injected working fluid is expanded against a liquid in the first zone and recompressed in the second zone, after which the recompressed working fluid is discharged from the LRHE.

In many of the embodiments of the method, the working fluid is rapidly cooled between the expanding step and the re-compressing step. In some of these methods, the step of rapidly cooling the expanded working fluid occurs in a third zone of the rotor positioned, in a rotational sense, between the first and second zones. In other of these methods, the step of rapidly cooling the expanded working fluid occurs by several substeps, including removing the expanded working fluid from the first zone, passing the removed working fluid through means for cooling that is external to the LRHE and reinjecting the cooled working fluid into the second zone of the LRHE In an improvement to known LRHE technology for extracting energy from a working fluid, the improvement is found in arranging a first zone in which the working fluid is expanded and a second zone where the working fluid is compressed in the same LRHE case In many of these improved LRHEs, the improvement also has a third zone, positioned in the case between the first and second zones, where the working fluid is cooled.

BRIEF DESCRIPTION OF THE DRAWINGS

A better understanding of the disclosed embodiments will be obtained from a reading of the following detailed description and the accompanying drawings wherein identical reference characters refer to identical parts and in which.

DETAILED DESCRIPTION

The embodiments of the inventive concept are based on the liquid ring compressor/expander concept, which is known in the prior art. As will be seen, the disclosed embodiments provide some different elements and require different operation. The "conventional" liquid ring machine of the prior art has only two ports. In the first port, the gaseous working fluid enters through a gas inlet. Once the working fluid either has energy extracted or added, depending upon the selected mode of operation, the working fluid leaves the device through a gas outlet. There are several possible implementations, but in all of the known implementations, an angular region (in the sense of rotation) is located between the respective inlet and outlet. This angular region allows time and space for the working fluid to be expanded or compressed, according to the machine function.

Figure 1:
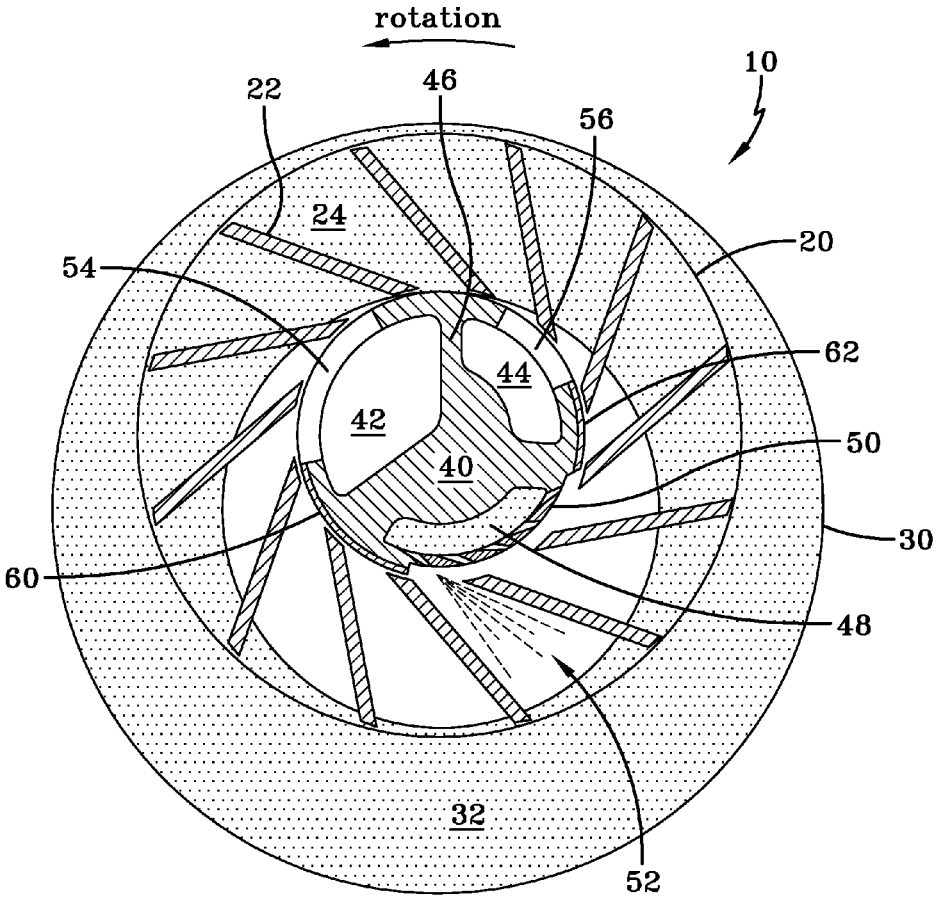
FIG. 1 is a sectional view looking down a major axis of a first embodiment of a liquid ring heat engine.

FIG. 1 depicts a schematic sectional view looking down the major axis of symmetry of a first embodiment 10 of a liquid ring heat engine. A rotor or impeller 20 is located inside a cylindrical case 30. Rotor 20 will typically be provided with a plurality of spaced-apart vanes 22, which are preferably symmetrically arranged, on a working face 24 of the rotor. A shaft 40 sustains the rotor 20, to which the shaft is coupled. The shaft 40 is eccentrically located with respect to an axis of symmetry of the case 30. Depending upon the application, case 30 may also be arranged to allow for it to rotate about its own axis of symmetry, for augmented system efficiency. The power output is taken from rotor 20, which may also turn the case 30 with equal or different speeds by suitable means. As depicted and described, the embodiment 10 operates by counterclockwise rotation. A frame (not shown) can provide a rigid and fixed means to receive the shaft 40. The mechanical arrangement, the shape of the vanes and related dimensions have been developed in, and can be found in, the prior art.

Beyond the strictly structural elements, an amount of a liquid is placed in the case 30, where it resides in an internal space 32 of the case. As is known from the prior art, the liquid effects a piston ring around rotor 20, due to centrifugal force from the spin of the rotor and especially of the vanes 22. While a rather small spin is enough to shape the liquid into the piston ring configuration, optimal functioning relative to the working pressure and geometry requires a typical tip speed at or above 10 m/s for the vanes 22. When case 30 is also being driven or is arranged for free rotation, even higher tip speeds may be desired.

Inside the shaft 40, a first conduit 42 supplies the energized or fresh working fluid to the working face 24. A second conduit 44 removes the expended working fluid from the working face 24. The respective conduits 42, 44 are separated from each other by a septum 46 which represents a top dead center ("TDC") position for rotor 20.

A third conduit 48 in shaft 40 supplies cooling liquid under pressure to a cooling means, depicted here as a cooler 50 having multiple nozzles. In practice, the cooler 50 will have an array of cooling sprays 52 as a result of the multiple nozzle arrangement, but only one is depicted in FIG. 1, to not complicate the drawing.

It will be typical and common to use the same liquid for cooling as is used in the internal space 32 to effect the piston ring, but there may be reasons in some application to not rigidly do this. However, use of the same liquid provides quite obvious advantage by eliminating a need for separation.

Turning now to the operation of the embodiment 10, the energetic working fluid enters the embodiment along the shaft 40 in first conduit 42 and passes through an inlet port 54 in the shaft onto a space in the rotor 20 that is defined by a pair of adjacent vanes 22, rotor face 24 and the piston ring provided by the fluid. In principle, the pressure inside the portion of the rotor 20 in communication with inlet port 54 is constant and equals the pressure existing in second conduit 44.

In terms of rotational direction, which is counterclockwise in FIG. 1, a first sealing surface 60 is located beyond the port 54. This first sealing surface 60, which is angularly fixed in place and does not rotate with the rotor 20, operates with the vanes 22, rotor face 24 and liquid piston ring to trap the working fluid inside the rotor 20. This geometry allows the working fluid to expand to a lower pressure and higher volume. As a practical point, the final expansion pressure should be as low as possible below the atmospheric pressure, perhaps limited only by cavitations.

As noted in FIG. 1, the depicted first sealing surface 60 extends rotationally to approximately the bottom dead center (BDC") of the rotor 20, with the angular distance between the beginning of the inlet port 54 to the end of the first sealing surface 60 generally defining a first zone of operation in which the working fluid is expanded.

Past the first sealing surface 60, using the rotational sense, a cooling zone is encountered by the trapped and now-expanded working fluid. In principle, the pressure inside this portion of the rotor 20 in communication with the cooling zone is constant and close to the final expansion pressure. The cooler 50 is arranged to spray cooling liquid into the cooling zone, removing heat from the working fluid. In the cooling zone, the pressure of the working fluid is reduced while the volume remains substantially constant. This process continues until the rotor 20 moves the trapped portion of working fluid past the cooling zone.

At the end of the cooling zone, a second sealing surface 62 is angularly fixed in place and serves to continue to trap the working fluid, along with the rotor face 24, the vanes 22 and the liquid piston ring. This new zone, which continues angularly through the point where the working fluid is exhausted from the embodiment 10, is a compression zone. The working fluid is compressed to, or at least close to, atmospheric pressure. Once past the second sealing surface 62, the working fluid can pass through outlet port 56 in the wall of shaft 40. From there, the expended working fluid passes into second conduit 44.

Figure 2:
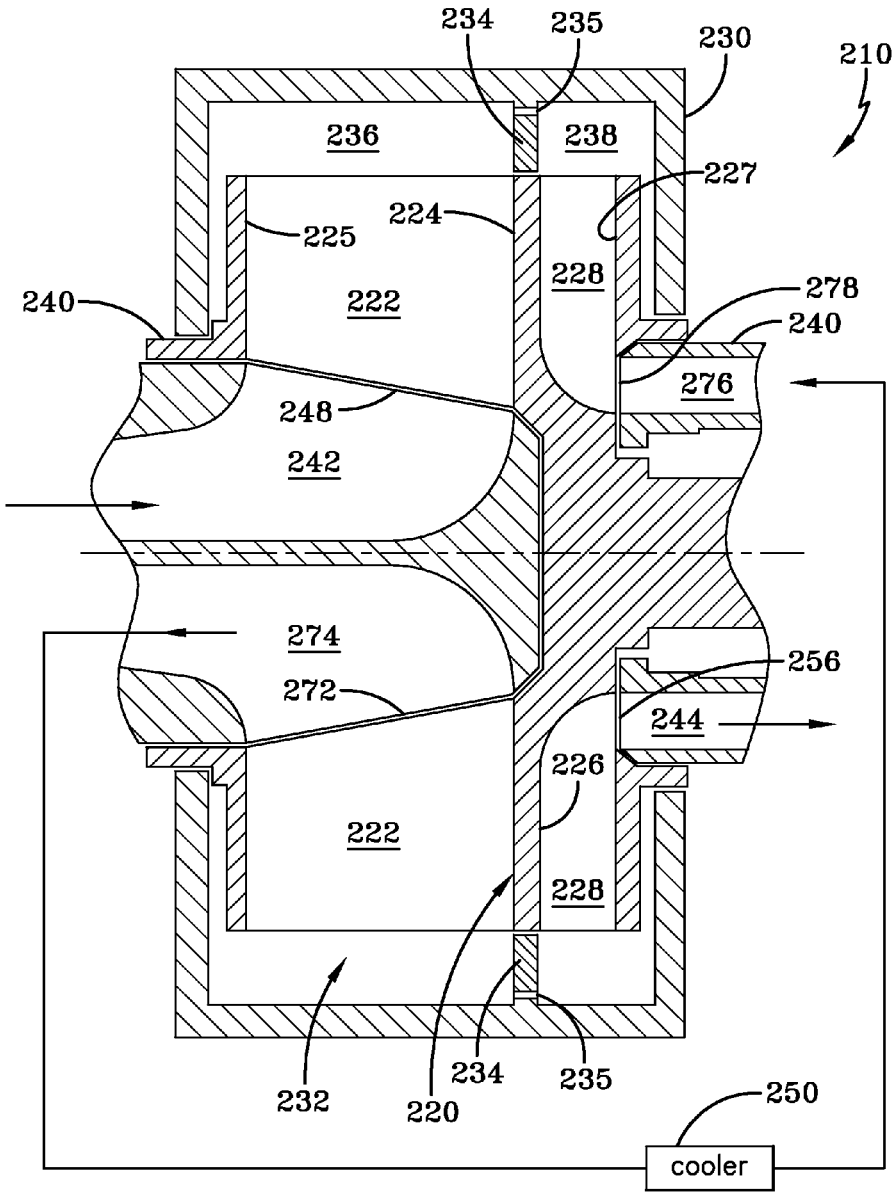
FIG. 2 is a side sectional view, taken along a major axis, of a second embodiment of a liquid ring heat engine.

FIG. 2 represents another embodiment 210 of a liquid ring heat engine. Rather than dividing a face of the rotor into a first zone where expansion occurs and a second zone where re-compression occurs, as well as an intermediate cooling zone, the rotor 220 has a first face 224 where the expansion occurs and a second face 226 where the re-compression occurs, with an intermediate cooling step that occurs external to the case 230 in which the rotor is contained. Each face 224, 226 is appropriately arrayed with vanes 222, 228. The vanes 222, 228 are symmetrically arranged on the respective faces, but the number of vanes may vary on each face of the rotor 220.

As before, the rotor 220 is contained in the interior 232 of case 230. Since the sectional depiction cuts through rotor 220 looking from a point representing top dead center, the eccentric placement of the rotor in the case is not seen, but this is an inherent feature of the liquid ring heat engine, as is the liquid which provides the liquid piston ring. An internal flange 234 that runs circumferentially inside case 230 effectively divides the case interior 232 into an expansion portion 236 and a re-compression portion 238. In many embodiments, it will be very desirable to provide a series of small passages 235 through flange 234, to allow equilibration of the piston liquid in each of the portions 236, 238.

The energetic working fluid passes along shaft 240 in conduit 242. Inlet port 248 allows the working fluid to radially enter the expansion portion 236, where the working fluid expands in a volume defined by a pair of vanes 222, the rotor face 224, a rotor top surface 225 and the liquid piston. After moving around the expansion portion 236, the expanded working fluid leaves the expansion portion in a radial direction through an intermediate outlet 272, through a conduit 274 and into a cooling means 250, where the working fluid is cooled.

Leaving the cooling means 250, conduit 276 injects the working fluid into intermediate inlet 278, which is depicted in FIG. 2 as an axial insertion into recompression portion 238. In the re-compression portion 238, the working fluid is recompressed in a volume defined by a pair of vanes 228, the rotor face 226, a rotor bottom surface 227 and the liquid piston. After moving around the re-compression portion 238, the working fluid leaves axially through outlet 256, through a conduit 244.

Figure 3:
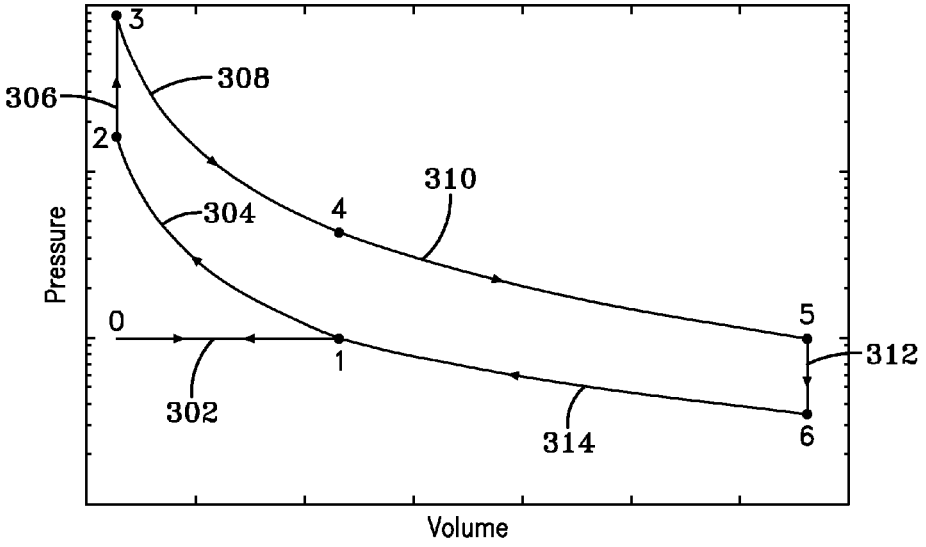
FIG. 3 is a pressure-volume diagram depicting the operation of the liquid ring heat engines according to both FIGS. 1 and 2.

FIG. 3 illustrates, in an idealized thermodynamic pressure versus volume representation, how the working fluid is handled in the embodiments described herein.

For exemplary purposes only, the working fluid passes through a very well known ideal Otto cycle, represented by segments 302, 304, 306 and 308, to increase the pressure and volume of the working fluid from that represented by point 0 to that represented by point 4. This Otto cycle is used as a "support cycle". Because the heat engine is conceived as a device for converting thermal energy from a high enthalpy gas, the operation of the heat engine is independent from the specific nature of the support cycle and of the type of gases used. Starting, then, at the thermodynamic state represented at point 4, which represents the end of the expansion stroke of the support cycle, the hot gases are discharged by the exhaust port of the support cycle engine and injected into the heat engine through appropriately-sized ducts.

Once in the heat engine, such as embodiment 10, the hot gases undergo the expansion represented by segment 310 in the first zone described relative to FIG. 1, the working fluid arriving at the condition indicated by point 5. In the cooling zone that angularly follows in the FIG. 1 embodiment 10, the rapid cooling of the working fluid by means of water spray injection or other suitable cooling process decreases the pressure while not affecting volume, taking the working fluid to point 6 along segment 312. Finally, as the working fluid enters the compression zone that is associated with sealing surface 62, the working fluid is recompressed along segment 314, arriving back at point 1. From here, the discharge of the working fluid occurs along segment 302, but in the opposite direction of the first step in the process.

The same process can be understood as occurring in relation to the FIG. 2 embodiment. Again starting in the heat engine at point 4, the expansion step 310 in the case's expansion portion 236 is followed by the cooling step 312 in the external cooler 250 and the compression step 314 occurs in the case, but on the opposing side of the rotor, in re-compression portion 238.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A liquid ring heat engine for extracting energy from a working fluid, comprising:

a cylindrical case;

a rotor, located inside the cylindrical case, the rotor defining, on a face thereof, a first zone where the working fluid is expanded, a second zone where the working fluid is compressed, and a third zone, positioned in a rotational sense between the first and second zones, said third zone comprising a cooler for cooling the working fluid, operatively arranged in the third zone;

a plurality of vanes, in spaced-apart relationship, on at least a portion of the rotor face;

a shaft, positioned eccentric to an axis of symmetry of the cylindrical case, the shaft and rotor coupled for rotation relative to the cylindrical case;

a space, internal to the cylindrical case, for receiving an amount of liquid that effects a piston ring around the rotor as the rotor rotates relative to the cylindrical case;

an inlet for the working fluid, open to the first zone through the shaft;

a conduit in the shaft to provide a cooling liquid to the cooler;

an outlet for the working fluid, open to the second zone through the shaft; and a flange, formed inside the cylindrical casing, the flange and the rotor coacting to effectively divide the internal space of the cylindrical case into an expander portion and a compressor portion, wherein energy to drive the liquid ring heat engine is extracted from the working fluid.

2. The liquid ring heat engine of claim 1, wherein:

the plurality of vanes are arranged symmetrically on one face of the rotor.

3. The liquid ring heat engine of claim 1, wherein:

each of the first and second zones is located on the face of the rotor on which the vanes are arranged.

4. The liquid ring heat engine of claim 1, wherein:

the plurality of vanes are arranged symmetrically on the face of the rotor.

5. The liquid ring heat engine of claim 1, wherein:

the first and second zones are located on a respective first face and a second face of the rotor.

6. The liquid ring heat engine of claim 1, wherein:

the inlet and outlet are each arranged radially with respect to the shaft.

7. The liquid ring heat engine of claim 1, further comprising:

a sealing surface, in fixed angular position relative to the rotor, operating with the vanes and rotor face to trap the working fluid inside the rotor during the expansion thereof in the first zone.

8. The liquid ring heat engine of claim 1, further comprising:

a sealing surface, in fixed angular position relative to the rotor, operating with the vanes and rotor face to trap the working fluid inside the rotor during the compression thereof in the first zone.

9. A method of extracting energy from a compressible working fluid, the method comprising the steps of:

injecting the working fluid into a liquid ring heat engine comprising a rotor defining at least a first and a second zone;

expanding the working fluid against a liquid in the first zone;

directing the working fluid to a cooler external to the liquid ring heat engine and rapidly cooling the working fluid that was expanded in the first zone by removing the expanded working fluid from the first zone, passing the removed working fluid through the cooler, and reinjecting the cooled working fluid into the second zone of the liquid ring heat engine;

directing the cooled working fluid from the cooler to the second zone and compressing the cooled working fluid in the second zone; and discharging the compressed and cooled working fluid from the liquid ring heat engine, wherein energy to drive the liquid ring heat engine is extracted from the working fluid.

10. The method of claim 9, wherein:

the step of rapidly cooling the expanded working fluid occurs in a third zone of the rotor positioned, in a rotational sense, between the first and second zones.

11. An improved liquid ring heat engine for extracting energy from a working fluid, comprising a cylindrical case, a rotor having at least one vaned face mounted on a shaft that is eccentrically positioned in the case, a fluid in an internal space of the case to provide a liquid piston when the rotor rotates on the shaft, the improved liquid ring heat engine comprising:

a first zone on the rotor where the working fluid is received into the first zone via a first conduit in the shaft and is expanded;

a second zone on the rotor where the working fluid is compressed and said compressed working fluid exits the liquid ring heat engine via a second conduit in the shaft;

an intermediate outlet from the first zone for the working fluid;

a cooler located external to the cylindrical case; and an intermediate inlet to the second zone for the working fluid, wherein the intermediate outlet, the cooler and the intermediate inlet define a conduit such that the working fluid exits the first zone, passes through the cooler and enters the second zone, wherein energy to drive the liquid ring heat engine are extracted from the working fluid.

12. The improved liquid ring heat engine of claim 11, wherein each of the first and second zones are located on one face of the rotor.

13. The improved liquid ring heat engine of claim 11, further comprising:

a flange, formed inside the cylindrical case, that coacts with the rotor to effectively divide the internal space into an expander portion and a compressor portion, with the first zone arranged on a face of the rotor in the expander portion and with the second portion arranged on an opposite face of the rotor, in the compressor portion.

* * * * *